US008006410B2

(12) United States Patent
Romboli et al.

(10) Patent No.: US 8,006,410 B2
(45) Date of Patent: Aug. 30, 2011

(54) SHOE, PARTICULARLY SPORT OR LEISURE SHOE

(75) Inventors: Sandra Romboli, Courbevoie (FR); Olivier Weber, Roost Warendin (FR); Maxime Roux, Tourcoing (FR)

(73) Assignee: Decathlon, Villeneuve d'Ascq (FR)

( * ) Notice: Subject to any disclaimer, the term of this patent is extended or adjusted under 35 U.S.C. 154(b) by 734 days.

(21) Appl. No.: 12/073,027

(22) Filed: Feb. 28, 2008

(65) Prior Publication Data

US 2008/0244928 A1 Oct. 9, 2008

(30) Foreign Application Priority Data

Apr. 3, 2007 (FR) ..... 07 54240

(51) Int. Cl.
*A43B 7/22* (2006.01)
*A43B 7/20* (2006.01)

(52) U.S. Cl. ..... 36/88; 36/91; 36/50.1

(58) Field of Classification Search ..... 36/88, 91, 36/50.1

See application file for complete search history.

(56) References Cited

U.S. PATENT DOCUMENTS

| | | | | |
|---|---|---|---|---|
| 1,283,335 | A * | 10/1918 | Shillcock | 36/170 |
| 4,282,657 | A * | 8/1981 | Antonious | 36/50.1 |
| 5,323,549 | A * | 6/1994 | Segel et al. | 36/140 |
| 5,819,439 | A | 10/1998 | Sanchez | |
| 6,286,233 | B1 * | 9/2001 | Gaither | 36/50.1 |
| 6,606,803 | B1 | 8/2003 | Ritter et al. | |
| 6,772,541 | B1 * | 8/2004 | Ritter et al. | 36/88 |
| 7,328,527 | B2 * | 2/2008 | Goldman | 36/100 |
| 2005/0115109 | A1 | 6/2005 | Goldman | |
| 2005/0126042 | A1 * | 6/2005 | Baier et al. | 36/50.1 |

* cited by examiner

*Primary Examiner* — Marie Patterson
(74) *Attorney, Agent, or Firm* — Kenyon & Kenyon LLP

(57) ABSTRACT

The invention relates to a shoe, especially for sport or leisure, comprising an upper, a sole and a lacing device having at least one clamping strip passing through a space arranged at the level of the sole and a clamping element. The clamping element is attached, on the one hand, to a first end of the clamping strip and, on the other hand, to a holding zone placed at the rear of the shoe. The second end of the clamping strip, passing through the clamping element comprises an attachment device on the upper, allowing the fixing of the strip. Cooperation exists between the clamping strip, the clamping element and the holding zone causing tensing of the upper at the level of the instep and the articulation above the heel.

12 Claims, 2 Drawing Sheets

SHOE, PARTICULARLY SPORT OR LEISURE SHOE

This application claims priority to French Patent Application No. 07/54240 filed 3 Apr. 2007, the content of which is incorporated herein by reference.

FIELD OF THE INVENTION

The invention relates to a shoe, especially for sport or leisure.

This shoe will be particularly adapted to running.

BACKGROUND OF THE INVENTION

This shoe could be utilised for indoor or outdoor activities; it could be a low-cut basket-type shoe or high safety boot especially for the practice of hiking.

Now, even though particularly provided for such applications the shoe could also be utilised in other applications, especially as a town shoe.

Two main lacing means are known for effecting clamping of the shoe around the foot of the user, specifically a lacing system cooperating with eyelets or even a clamping strip generally comprising a scratch and cooperating with a side of the shoe.

The present invention constitutes a refinement to shoes equipped with lacing means having at least one clamping strip.

In this respect, a first relatively simple embodiment is already known in which the strap is submitted to one side of the shoe and the end of which passes through an opening or an eyelet fixed to the other side of the shoe to be fixed back on the first side especially by means of scratch.

This lacing mode is particularly interesting, since it executes clamping and unclamping of the shoe which is at the same time rapid, simple and reliable.

This embodiment is especially adapted for equipping children's shoes.

All the same, this embodiment also has disadvantages and especially, because clamping is done solely at the level of the instep and also because the force of the clamping tends to decrease, the clamping strip capable of progressively loosening as a function of the movements of the shoe.

There is also the disadvantage of clamping only the upper and/or the top of the shoe, resulting in the foot being compressed on the sole.

There is also a second known embodiment with a clamping strip in which the clamping strip passes through a space made at the level of the sole, wraps around the shoe, then passes through an opening or an eyelet to reach a position on the other side of the shoe.

This embodiment enables increased clamping relative to the first abovementioned embodiment allowing more specialised utilisation of the shoe; this lacing mode especially has already been proposed for making weight lifting shoes, with proper execution of this sport requiring significant contact between the sole of the shoe and the foot of the user to prevent loss of adherence of the weight lifter during exercising.

Here too, this embodiment has disadvantages, especially the fact that this type of lacing does not prevent significant play at the level of the ankle of the user, lacing being in fact circumscribed at the level of the instep of the user, that is, at the level of the tarsus bone and does not permit efficacious clamping at the level of the ankle.

The aim of the present invention is to rectify the disadvantages of the two embodiments of the abovementioned lacing means with a clamping strip and propose a shoe especially for sport and leisure fitted with lacing means having at least one clamping strip allowing clamping on the foot of the user at the same time at the level of the instep of the user and his articulation.

Another object of the present invention is to propose a shoe, especially for sport or leisure, characterised in that the clamping strip can be positioned and fixed easily and reliably.

SUMMARY OF THE INVENTION

The object of the invention is thus a shoe, especially for sport or leisure, comprising an upper, a sole and a lacing device with at least one clamping strip passing through a space made at the level of the sole and a clamping element.

According to the invention:

- the clamping element is attached, on the one hand, to a first end of the clamping strip and, on the other hand, to a holding zone located at the rear of the shoe,
- the second end of the clamping strip, passing through the clamping element, comprises an attachment device on the upper allowing the fixing of the strap, cooperation between the clamping strip, with the clamping element and the holding zone causing tensing of the upper at the level of the instep and of the articulation above the heel.

This characteristic enables the foot of the user to be held completely by using one or more clamping strips cooperating with a holding zone made solid with the rear of the shoe.

According to an advantageous characteristic, the holding zone comprises a principal holding zone extending at the level of the part of the shoe attached to two lateral and medial extensions, placed so as to encircle the ankle of a user.

This characteristic ensures tensing during positioning of the clamping strip, while ensuring proper comfort for the user.

According to another advantageous characteristic of the invention, the attachment device of the clamping strip are positioned on the upper part of the clamping strip and on the outer extension.

This characteristic ensures continuous tensing, that is, integrally surrounding the ankle of the user.

According to another advantageous characteristic of the invention, this attachment device is of the loop and hook type to facilitate positioning and withdrawal of the clamping strip.

In another advantageous embodiment of the invention it is provided that the shoe comprises an additional attachment device placed on the lower part of the clamping strip.

When the clamping strip is in position this characteristic increases the bond between the clamping strip and the shoe. When the shoe is released from the foot of the user, this characteristic prevents the clamping strip dragging on the ground.

According to an advantageous embodiment of the invention, the holding zone comprises at least one supple piece submitted to the upper of the shoe.

This characteristic especially facilitates production operations of shoes.

According to another advantageous characteristic of the invention, the opening made in the clamping element and allowing passage of the clamping strip comprises a rigid piece preventing deformation of the opening when the tension of the clamping strip is exerted.

The aim of this characteristic is also to prevent premature wear of this opening, which might make it difficult to introduce the clamping strip.

BRIEF DESCRIPTION OF THE DRAWINGS

Other characteristics and advantages of the invention will emerge more clearly from the following description of a preferred embodiment in which the description is given only by way of non-limiting example and in reference to the attached diagrams, in which.

DETAILED DESCRIPTION

Figure 1:
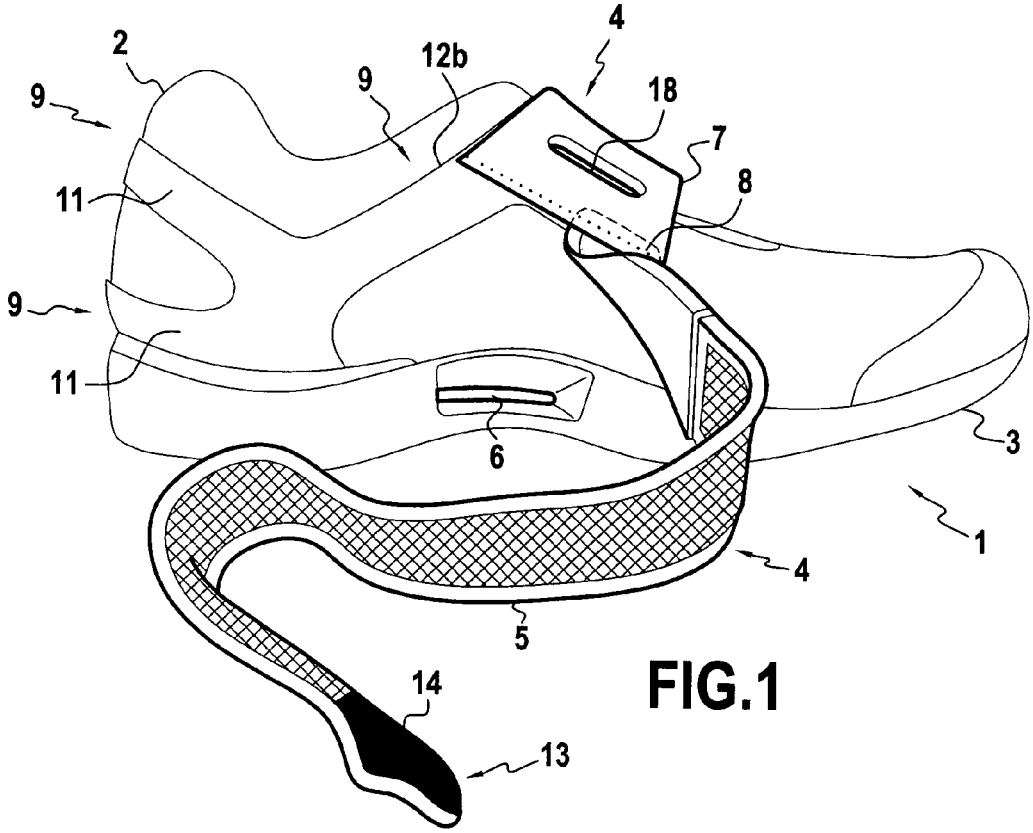
FIG. 1 schematically shows a perspective view of an embodiment of the shoe according to the invention.

With reference equally to FIGS. 1 to 4, a shoe 1 comprising an upper 2, a sole 3 and a lacing device 4 is shown.

This lacing device 4 comprises a single clamping strip 1 in the embodiment in FIGS. 1 to 4; however, there could also be a number of clamping strips 5 which could be superposed, or aligned parallel to one another or even crossed.

The shoe 1 also comprises a space 6 made at the level of the sole 3 and allowing passage of the clamping strip 5.

The shoe 1 further proposes a clamping element 7.

This clamping element 7 is attached to a first end 8 of the clamping strip 5 and also attached to a holding zone 9 located to the rear of the shoe 1.

Figure 2:
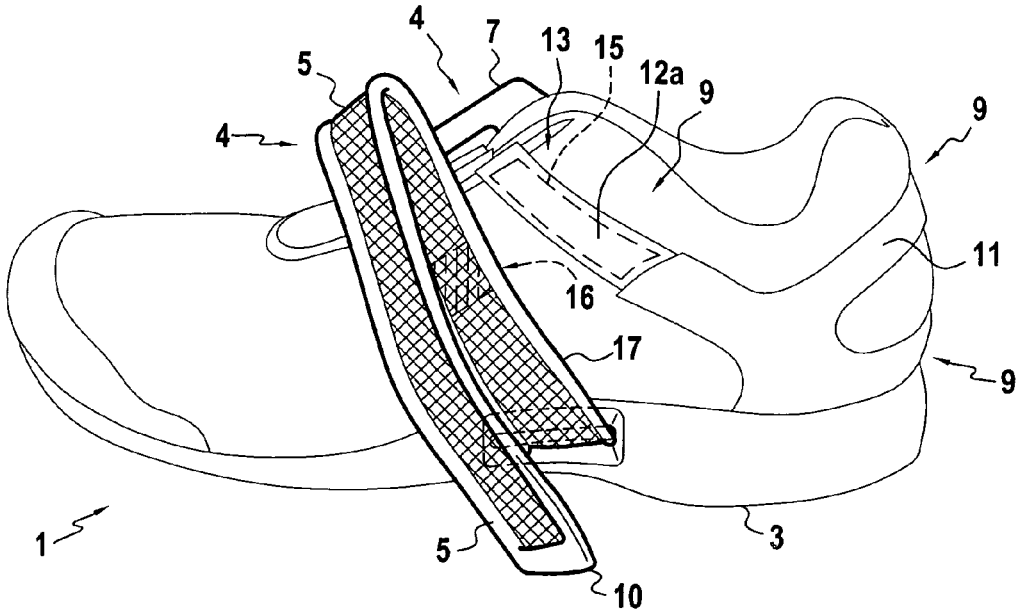
FIG. 2 also shows the embodiment of FIG. 1 according to another viewing angle.

In reference now more particularly to FIG. 2, it is evident that the second end 10 of the clamping strip 5 can be introduced through the space 6 by the user.

The position illustrated in FIG. 2 corresponds to an unlaced position; it is not actually necessary to fully withdraw the strap 5 to be able to position the foot in the shoe 1.

With reference to FIGS. 1 and 2, it is also evident that the holding zone 9 comprises a principal zone 11 attached to two lateral 12*a* and medial 12*b* extensions.

The entire principal holding zone thus encloses the ankle of the user.

An attachment device 13 is provided for tensing of the upper 2, this attachment device 13 comprising a first part positioned on the upper part 14 of the clamping strip 5 and a second part 15 on the lateral extension 12*a* of the shoe 1.

Advantageously, the attachment device 13 will be of loop and hook type; however, other embodiments of attachment familiar to the expert could also be envisaged.

In this respect, according to an advantageous characteristic of the invention, an additional attachment device 16 is also placed on the lower part 17 of the clamping strip 5, this additional attachment device 16 preventing the strap 5 from dragging on the ground when the strip 5 is in the position illustrated in FIG. 2.

Figure 3:
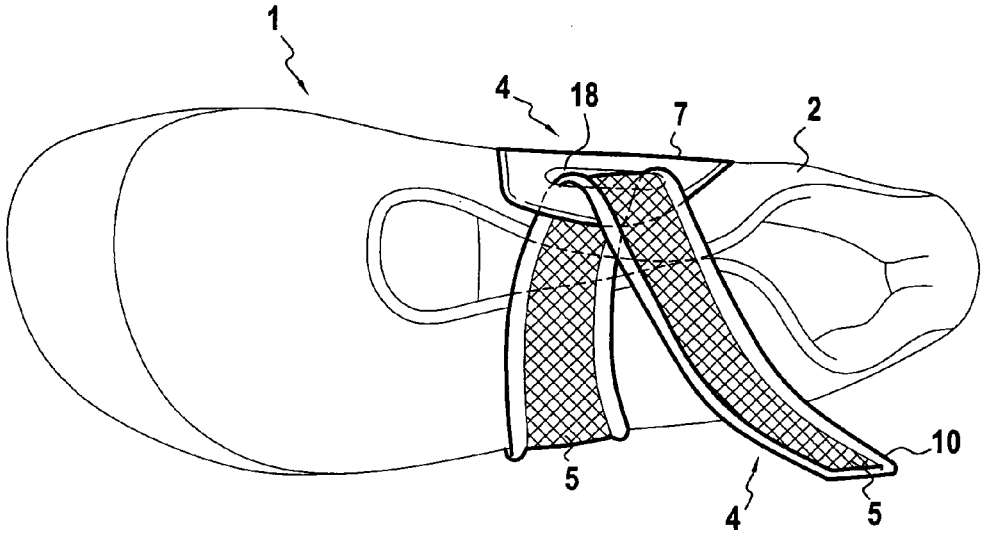
FIGS. 3 and 4 show two new views of the shoe illustrated in FIGS. 1 and 2 in perspective and in laced position.
Figure 4:
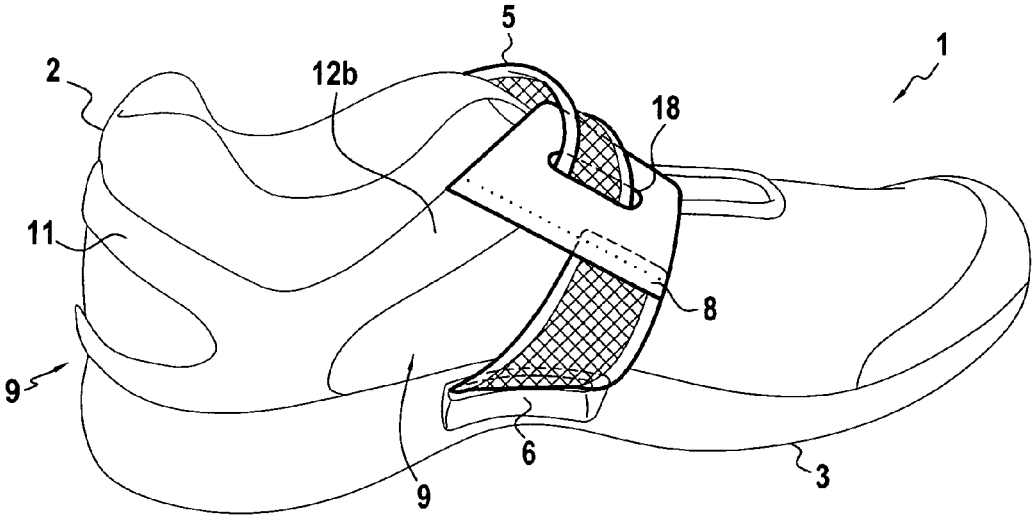

With reference now chiefly to FIGS. 3 and 4, the shoe 1 is shown in the laced position and cooperation between the clamping strip 5 and the clamping element 7 is evident.

More precisely, the end 10 of the clamping element has been introduced through an opening 18 made in the clamping element 7, then the user has exerted traction on this clamping strip 5 to plate it against the lateral extension 12*a* and the principal holding zone 11, the attachment device 13 allowing this position to be kept.

The traction exerted on the strip 5 and the positioning at the level of the holding zone 9 allow tensing of the upper 2 by cooperation between the clamping strip 5, the clamping element 7 and said holding zone 9.

Once positioned, clamping of the shoe is complete; this can thus be easy manipulation resulting in effective clamping of the foot of the user.

It is important to note at this level that, for proper clamping and tensing, it is provided advantageously that the elements of clamping 7, the holding zone 9 and the end of the clamping strip 5 form a single piece. In the event where separate pieces are used, it is provided that the clamping element 7 is attached to the holding zone 9 and also to the first end 8 of the clamping strip 5 by its lower edge.

To create the holding zone according to an advantageous embodiment and especially for proper tensing of the upper 2, it is provided that this holding zone 9 comprises at least one piece supple further submitted to the upper 2 of the shoe 1.

Advantageously also, it is provided that this holding zone 9 is at least partially stuck on the upper 2 of the shoe 1.

Here too, other embodiments of the bond between the holding zone 9 and of the upper 2 are also feasible and it could especially be envisaged that the holding zone 9 is stuck onto the upper 2.

With respect to the opening 18, it is important to note that the latter will partly take up the traction forces exerted by the user on the clamping strip 5 during clamping of the shoe 1; consequently, to avoid deformation and possibly rapid wear a first rigid piece substantially fitting the shape of the opening 18 and placed solidly inside this opening 18 is advantageously provided at the level of this opening 18.

Advantageously, this rigid piece will be made of a material favouring sliding of the clamping strip 5.

Similarly, a second rigid piece substantially adopting the shape of the opening 6 and placed solidly inside the latter is also provided at the level of the opening 6.

Also, this clamping strip 5 is also constituted by a supple non-extensible material to make it easy at the same time to introduce into the opening 18 and also into the opening 6.

It is understood that other embodiments familiar to those skilled in the art could also have been envisaged, without as such departing from the scope of the invention defined by the claims hereinbelow.

The invention claimed is:

1. A shoe, especially for sport or leisure, comprising an upper, a sole and a lacing device with at least one clamping strip passing through a space in the sole and a clamping element wherein the clamping element is attached to a first end of the clamping strip and to a holding zone, and the second end of the clamping strip, passing through an opening of the clamping element comprises an attachment device on the upper allowing fixing of the strap, with cooperation between the clamping strip, the clamping element and the holding zone causing tensing of the upper.

2. The shoe according to claim 1, wherein the holding zone comprises a principal holding zone attached to lateral and medial extensions.

3. The shoe according to claim 2, wherein the attachment device of the clamping strip comprises a first part positioned on the upper part of the clamping strip and a second part on the lateral extension.

4. The shoe according to claim 3, wherein the attachment device is a loop and a hook.

5. The shoe according to claim 1 comprising an additional attachment device placed on a lower part of the clamping strip.

6. The shoe according to claim 1, wherein the holding zone comprises at least one piece connected to the upper of the shoe.

7. The shoe according to claim 6, wherein the holding zone is at least partially sewed onto the upper of the shoe.

8. The shoe according to claim 1, wherein the clamping element is attached to the holding zone and to the first end of the clamping strip at its lower edge.

9. The shoe according to claim 1, wherein the clamping element, the holding zone and the first end of the clamping strip are made from a single piece.

10. The shoe according to claim 1, wherein the opening in the clamping element that allows passage of the clamping strip comprises a first rigid piece preventing deformation of the opening when tension from the clamping strip is exerted.

11. The shoe according to claim 1, wherein the space comprises a second rigid piece positioned therein.

12. The shoe according to claim 1, wherein the clamping strip is comprised of a supple non-extensible material.

* * * * *